United States Patent [19]

Collins

[11] 4,051,613

[45] Oct. 4, 1977

[54] MARTIAL ARTS BOOT

[76] Inventor: Ronald Eugene Collins, 6001 Ruatan St., Berwyn Heights, Md. 20740

[21] Appl. No.: 643,912

[22] Filed: Dec. 23, 1975

[51] Int. Cl.[2] ..... A43B 5/00; A43B 19/00

[52] U.S. Cl. ..... 36/114; 36/71

[58] Field of Search ..... 36/71, 83, 102, 114, 36/115, 110, 1, 4

[56] References Cited

U.S. PATENT DOCUMENTS

| | | | |
|---|---|---|---|
| 1,726,198 | 8/1929 | Stahl | 36/83 |
| 3,555,706 | 1/1971 | Edmonds | 36/71 R |
| 3,667,140 | 6/1972 | Hunderford | 36/4 |

*Primary Examiner*—Patrick D. Lawson

*Attorney, Agent, or Firm*—Ulle C. Linton

[57] ABSTRACT

This invention builds into a standard high or ankle covering boot new and novel structure which consists of the specific padding required to make the boot safe for use in Full-Body-Contact Karate, Kick Boxing, and similar martial combat sports. The padding built into the boot has specific structure.

1 Claim, 4 Drawing Figures

MARTIAL ARTS BOOT

PRIOR ART

There appears to be no prior art which reads against the building into the structure of a boot specific padding and other structure which protects not only the foot of the wearer but also that part of another human body which the boot hits in the martial sports. A search has turned up the following patents in related art: U.S. Pat. Nos. 208,897, Emerson; 1,118,130, Hasmer; 1,660,203, Morgan; 2,276,398, Hasker; 2,306,306, Ferrettie; 3,106,790; 3,531,878, Corry; 3,667,140, Hunderford; 3,691,658, Di Permo; 3,769,722, Jhon Rhee. This art teaches a number of separate pads which are not built into the boot, but which are strapped to it. Unless such extra pads are very tightly strapped to the boot they may well slip and change position or be torn off entirely. The straps themselves include edges which can cut the participant who is hit with such a boot. If the straps are tight enough the free movement of the boot and the foot it encloses are hampered to the point of danger. The building into the boot of the specific pads needed obviates all the difficulties cited.

One object of the invention is to provide single-piece equipment with which the martial combat sports can be made safe for both participants in a one-on-one combat contest. The martial sports provide sharp contact of the feet and hands of one participant on parts of the body of the other participant. Without the adequate padding of the foot, such contacts can be dangerous, both to the person being hit and to the hand or foot making the contact. The object is to protect the participants.

Another object is to build the required padding directly into the structure of a boot used in the martial sport so that on contact with another person, the padding will not slip or change position in such a way as to present sharp edges, nor will the padding be torn loose entirely by the force of the impact.

These objects are both related to a larger object, that of expanding the participation of people in the martial sports, expansion without either the fear of a lack of safe equipment or the lack itself, both of which could contribute to injuries and the lack of desire to participate.

This invention lies in specific modifications to the structure of a standard boot or high shoe to change its character, and the best way to explain it is to start from the drawing of a standard boot, a drawing which is generalized, and point out the new and novel changes in structure from the drawing.

Figure 3:
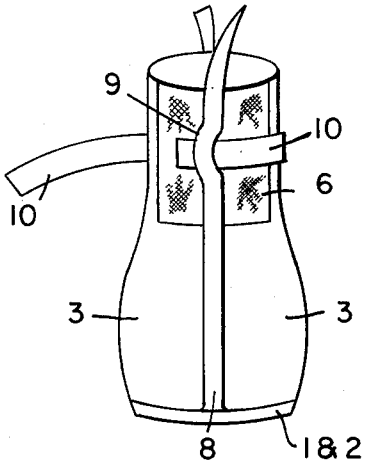
FIG. 3 shows the detial of the rear of the boot, a detail not visible from the side view given in FIG. 1.

The standard boot consists of a single sheet or a set of sheets of leather or fabric conformed to a last, which is a block or form in the shape of a foot. Lasts come in a wide variety of sizes and shapes. The invention is not specific to any particular last and covers the boot in a generalized fashion. In standard nomenclature, the part above the foot, enclosing the upper ankle and the lower leg is called the quarter. The part of the boot enclosing the foot is called the vamp. These two sections normally come in one piece which is collectively called the upper, shaped by being drawn tight around the last. The upper is attached by a variety of methods to the inner sole, which by definition is the upper half of the sole, and all of this structure is attached to the bottom of the sole, called simply the sole. The standard boot carries a heel but this invention applies to a boot without a defined heel, and that element of a standard boot is not shown in any figure given here. Similarly, the standard boot would have eyelets on both sides of a slit down the front, strings and a tongue, all of this structure being required for closure of the slit and attachment of the boot to the foot. The slit is in turn required so that the boot can be slipped over the foot.

In the present invention, all of this structure for closure is omitted, and the drawing reflects the absence of these items which would normally appear along the top of the boot from the top of the toe to the top of the boot itself. In view of the inclusion of an elastic section of the upper as will be described, there is no slit for closure, and the boot has a solid seam from the vamp to the top of the boot itself. This is omitted from the drawings.

Figure 1:
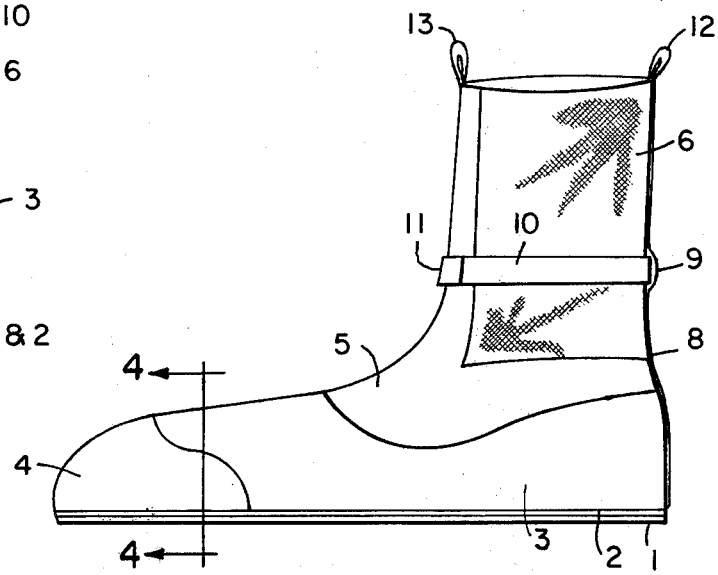
FIG. 1 is a side view of the outline of a standard boot.
Figure 4:
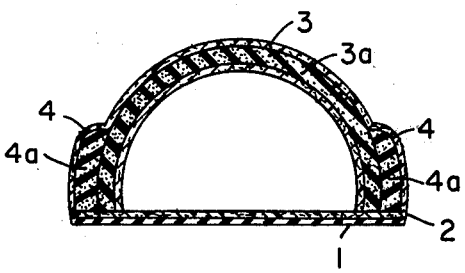
FIG. 4 is a cross-section taken across the toe of the boot on section line 4—4 of FIG. 1.

In FIG. 1, at the base of the boot is outer rubber sole 1, attached to inner sole 2, which is in turn attached to vamp 3. All of vamp 3 contains an internal padding 3*a*, which is not shown in FIG. 1 but which appears in FIG. 4. Vamp 3 goes out all the way to the toe of the boot and is covered near the toe by extra pad 4 which goes along the sides of the foot and over the top of the toe, the shape included in the drawing being duplicated on the side of the boot not shown. In FIG. 4 toe padding is shown by reference character 4*a*. Above vamp 3, appears upper 5, covering an area along the foot and up the leg. Cut into the upper 5 is elastic fabric section 6, covering much of the side of the ankle, and particularly the area over the ankle bone, as well as all the back of the leg above the foot. It is this area of elastic fabric which permits the boot to be drawn over the foot in putting it on. At the rear of the boot is back strap 8, in which at a point well above the vamp 3 a loop is formed which stands away from the back seam. The loop has reference characer 9. Back strap 8 terminates at the top of the boot itself in a loop 12 used to pull the boot over the foot. A similar loop at the front of the boot is identified as 13. Around the elastic fabric section 6 and around the front of the upper 5 is passed a strap made of Vel-cro or similar self closing material under pressure, identified as 10. At the front seam of upper 5 strap 10 is sewed to the surface of the boot, the attachment identified as 11. It will be noted that there are a number of seams notably the one attaching vamp 3 and upper 5, the one attaching vamp 3 to extra pad 4, and the one attaching upper 5 to elastic fabric section 6.

Figure 2:
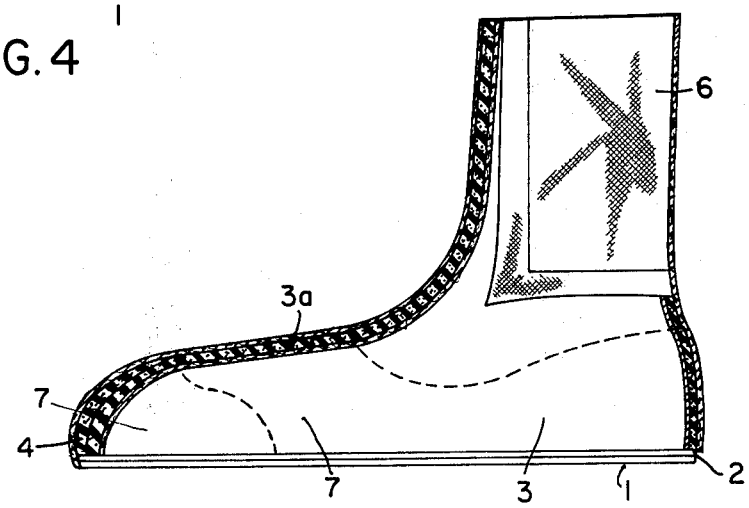
FIG. 2 is a view of the same side of the boot from the inside. It is equivalent to what would be shown by a cross section view of the boot from toe to heel.

FIG. 2 is much simplified from Figure. Inner sole 2 and outer sole are at the base of the boot. Padding 7 covers the inside of the boot in the areas of both vamp and upper in the shape shown. Elastic fabric 6 is the only area left unpadded. The vamp 3 and toe pad 4 are shown by broken lines, both being details not visible from the inside.

FIG. 3 depicts the back of the boot. At the bottom soles 1 and 2 are shown. Back-strap 8 runs from the base of the boot to the top, with loop 9 placed well above the vamp, and back strap 8 terminates in loop 12. Loop 13 at the front of the boot is also shown. Vamp 3 occupies the lower portion of the view, with elastic fabric section 6 occupying the rest of the view. Vel-cro binding strap is largely invisible but the ends 10 appear.

FIG. 4 is a cross section view of the toe of the boot, taken on section line 4—4 of FIG. 1, looking toward the front of the toe. Soles 1 and 2 are at the bottom. The toe of the foot would be inserted into the open space shown in the center. Vamp 3 surrounds the open space and padding 3*a* is shown to indicate how it surrounds the foot on sides and top. Toe pad 4 is shown as the outer surface of the wings on the vamp. Padding 4*a* fills all the space on either side of vamp 3. In this regard it is worth noting that a cross section taken on a section line much farther forward in the boot would show 4 and 4*a* totally surrounding vamp 3.

In the above description, it is not intended to limit the scope of the invention to a boot made with a single brand of binder strap material such as Vel-cro. Any fabric which can be pressed together to form a bond could be used, the point being the absence of hooks or buttons for closure. It would be further understood that such a boot is to be made in a wide variety of sizes and shapes, to fit the variety of feet presented by participants in the sport. Thus the inventor may make slight modifications in the shapes of the parts without going beyond the scope of the invention.

Having thus described the new and novel aspects of this present invention, I claim:

1. A martial arts boot comprising inner and outer soft rubber soles, a vamp being attached to said soles, a padding totally covering the inner surface of said vamp, a boot upper being attached to said vamp, said padding extending upwardly from said vamp over the inner front and side portions of said upper, a cap padding covering only the sides and front of the toe portion of said vamp and said upper having an elastic rear side portion.

* * * * *